United States Patent [19]

Atkin

[11] Patent Number: 4,564,191

[45] Date of Patent: Jan. 14, 1986

[54] ARM WRESTLING MACHINE

[76] Inventor: Norman M. Atkin, 5620 Amistad NE., Albuquerque, N. Mex. 87111

[21] Appl. No.: 617,252

[22] Filed: Jun. 4, 1984

[51] Int. Cl.[4] ..... A63B 5/00

[52] U.S. Cl. ..... 272/67; 272/142; 272/901; 73/380

[58] Field of Search ..... 272/901, 67, 68, 142, 272/130, 116, DIG. 1, 129; 73/379, 380

[56] References Cited

U.S. PATENT DOCUMENTS

| | | | |
|---|---|---|---|
| 929,281 | 7/1909 | Brodeur | 73/381 |
| 1,115,826 | 11/1914 | Johnson | 73/380 |
| 2,526,495 | 10/1950 | Meyer | 73/330 |
| 2,782,033 | 2/1957 | Ugartechea | 272/67 |
| 3,078,718 | 2/1963 | Hoke | 73/380 |
| 3,400,793 | 9/1968 | Norris et al. | 272/901 X |
| 3,662,602 | 5/1972 | Weiss | 73/381 |
| 4,214,748 | 7/1980 | Blackmon | 272/67 |
| 4,351,523 | 9/1982 | Alexander | 272/67 |
| 4,382,795 | 5/1983 | Collins | 434/258 |
| 4,406,464 | 9/1983 | Dean | 272/901 X |
| 4,425,797 | 1/1984 | Morrison | 73/379 |

*Primary Examiner*—Richard J. Apley
*Assistant Examiner*—David J. Brown
*Attorney, Agent, or Firm*—Warren F. B. Lindsley

[57] ABSTRACT

A coin operable arm wrestling apparatus employing a plurality of springs which are selectively connectable to a drive shaft for urging it in one direction which drive shaft is rotated by arm movement of a user in another direction. The apparatus is electrically energized to indicate use and win and locks itself out after a predetermined time.

7 Claims, 10 Drawing Figures

FIG. 1
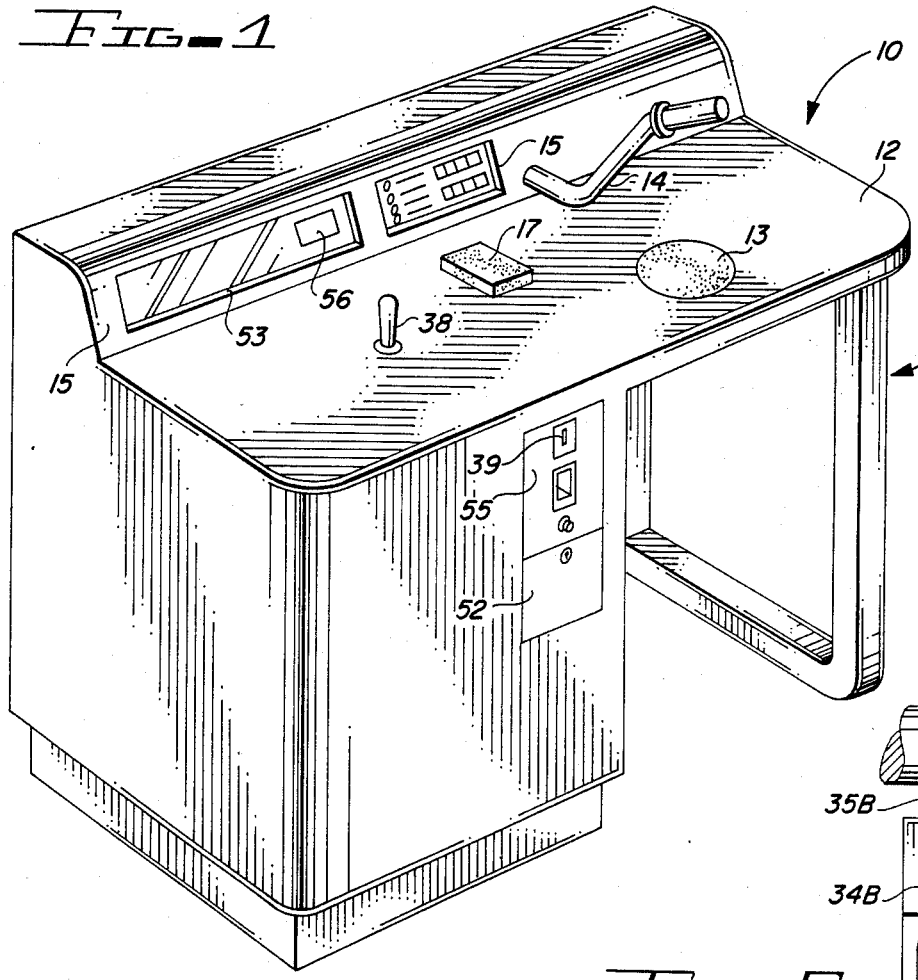
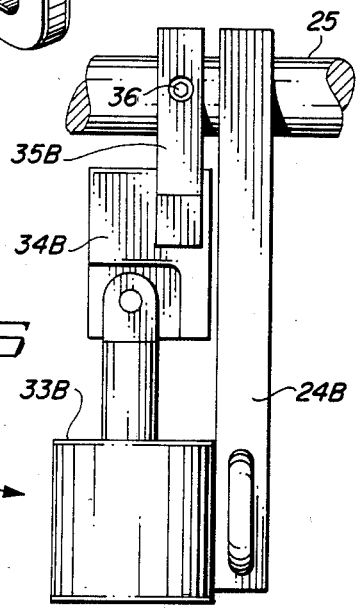
FIG. 5
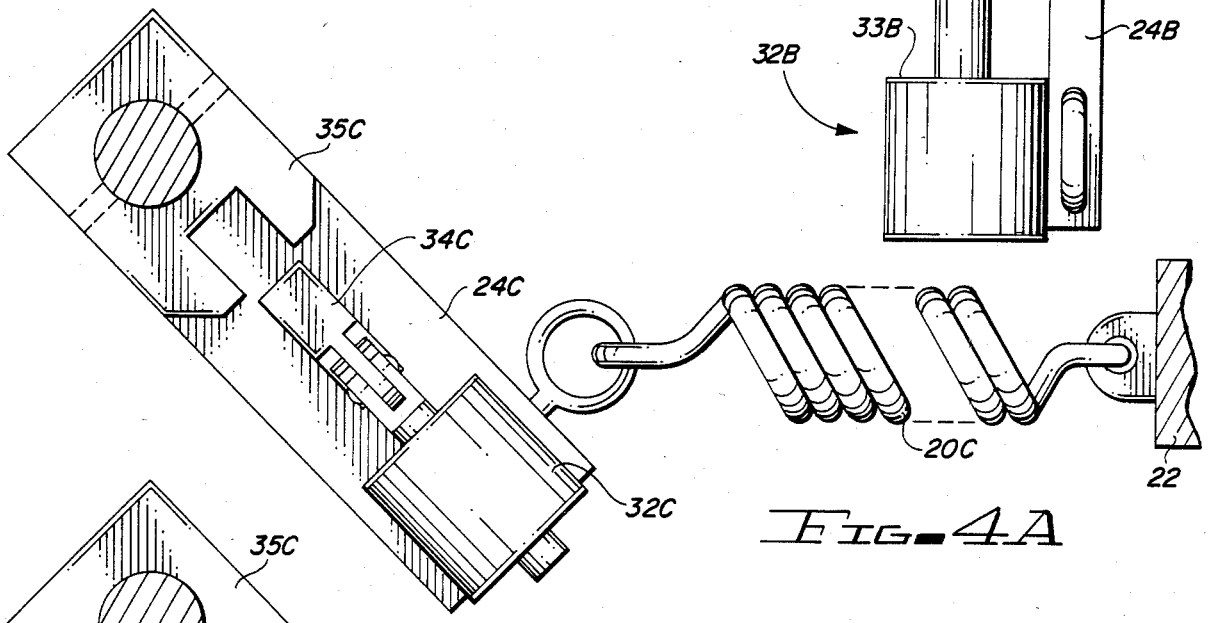
FIG. 4A
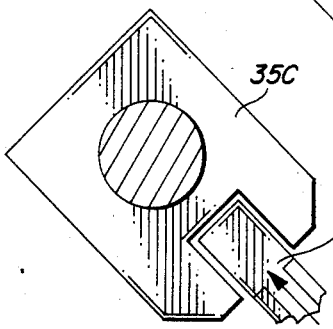
FIG. 4B

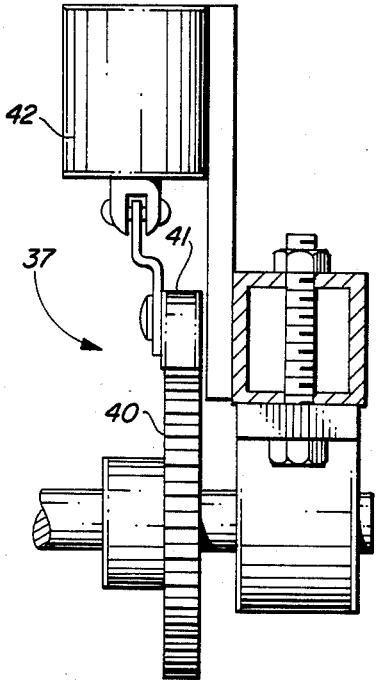
FIG. 7
FIG. 8
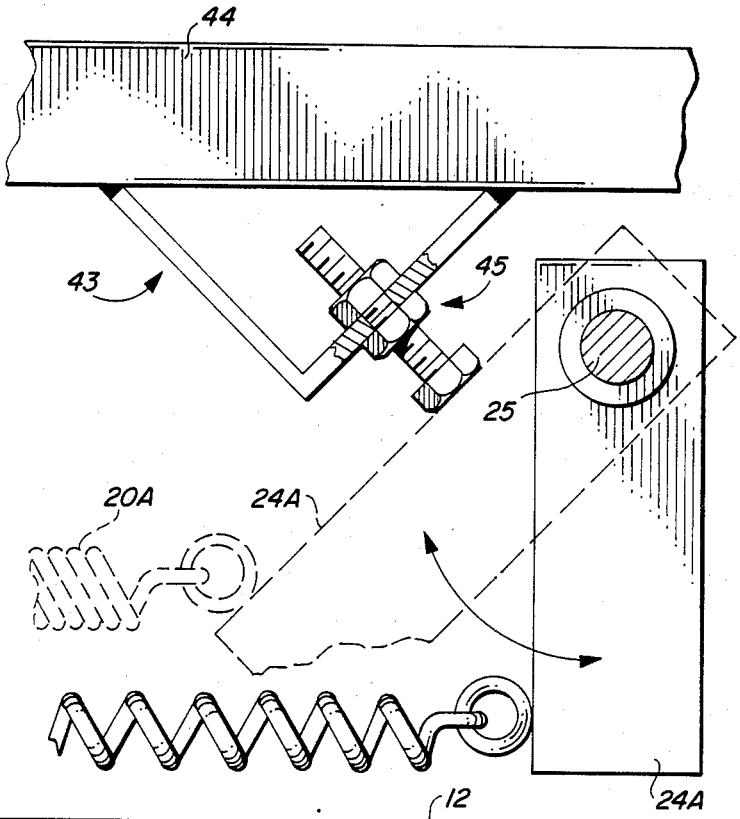
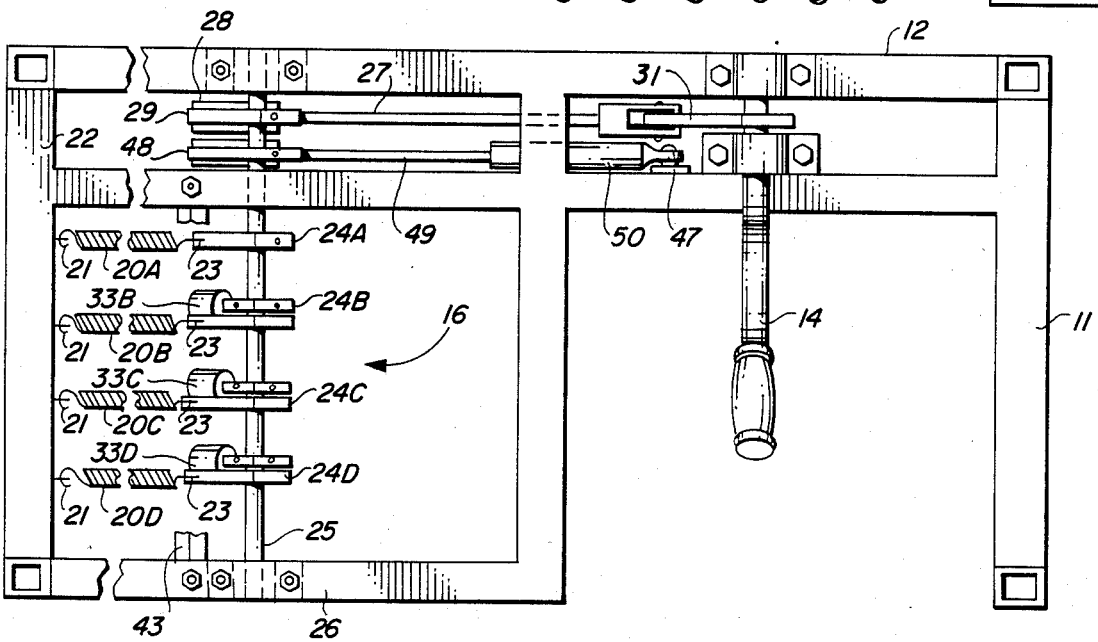
FIG. 3

ARM WRESTLING MACHINE

BACKGROUND OF THE INVENTION

The very old sport of arm wrestling has recently experienced a resurgence in popularity. Enthusiasts are coming together for meets at which contestants vie for prizes and championships. The sport is practiced in health spas, as well as in the local bars or pubs.

In the practice of the sport, two contestants may sit or stand opposite each other at a small table, each with an elbow on the table and gripping the other's hand. At a signal from the referee, each participant begins straining against the other, attempting to force his arm backward until his hand is driven against the table. The first to succeed is declared the winner.

The present invention relates generally to an arm wrestling apparatus, but one in which the operator competes against a machine wherein the machine is selectively programmed to offer preselected resistances, thereby also serving as an exercising apparatus of the hand and arm strengthening variety.

Exercising apparatus of the hand and arm strengthening variety are well known and assembled in numerous shapes and arrangements for permitting a user to exercise and strengthen his or her hands and arms.

The present invention employs a set of coil springs selectively engaged in a novel manner for providing preset resistances to the movement of a handle which is resiliently associated with one, a number or all of the coil springs. The present invention also provides a reference structure to which the user may refer to permit determination of the strength of the user or the user's day-to-day progress over extended periods of exercise.

DESCRIPTION OF THE PRIOR ART

U.S. Pat. No. 4,351,523 discloses an arm wrestling device having a series of springs the force of which may be adjusted by removing or adding springs. However, the means of adding or subtracting springs is different and not as easily handled as disclosed herein.

U.S. Pat. No. 4,214,748 discloses an arm wrestling device utilizing a series of springs which are simultaneously attached to the bite of a U-shaped bolt.

U.S. Pat. No. 929,281 discloses a muscle testing machine utilizing a series of springs of varying strength requiring greater effort as additional springs are tensioned.

U.S. Pat. No. 1,115,826 discloses a strength testing device utilizing short and relatively long coil springs which are brought into play at predetermined periods in the movement of the handle.

U.S. Pat. Nos. 2,526,495; 2,782,033; 3,078,718; 3,662,602; 4,382,795 and 4,425,797 all disclose some form of arm wrestling and/or arm strengthening device, but none of them disclose the particular selectively implemented single operator arm wrestling device disclosed and claimed herein.

SUMMARY OF THE INVENTION

In accordance with the invention claimed, a new and improved single operator arm wrestling and strengthening device is disclosed that can be selectively activated to select a given spring resistance against which an operator may safely compete, avoiding the hazards and inequities of the dual operated arm wrestling apparatus usually associated with the sport.

It is, therefore, one object of the present invention to provide a new and improved single operator arm wrestling and strengthening apparatus.

Another object of this invention is to provide a new and improved arm wrestling device which will assure an equal mechanical resistance for each contestant or operator using the apparatus.

A further object of this invention is to provide an arm wrestling apparatus that will substantially eliminate the hazards of physical injury that are presently associated with the sport.

A still further object of this invention is to provide a mechanical coin operated arm wrestling device or apparatus in a form suitable for use in health spas, bars and other recreational establishments where its benefits and advantages will serve to enhance the popularity of the sport.

Yet another object of the invention is to provide such a mechanical arm wrestling device in a simple and reliable form that is inexpensive to manufacture.

Further objects and advantages of the invention will become apparent as the following description proceeds and the features of novelty which characterize the invention will be pointed out with particularity in the claims annexed to and forming a part of this specification.

BRIEF DESCRIPTION OF THE DRAWINGS

The present invention may be more readily described by reference to the accompanying drawings, in which:

FIG. 1 is a perspective view of a mechanical arm wrestling device embodying the invention;

FIG. 3 is a plan view of the arm structure and its resistance components shown in FIG. 2;

FIG. 4A is an enlarged view of one of the coil spring mechanisms and its associated solenoid operator;

FIG. 4B is a partial view of FIG. 4A showing parts of the solenoid in operable position;

FIG. 5 is a side view of the solenoid operator shown in FIG. 4A;

FIG. 7 is a right-end view of FIG. 6;

FIG. 8 is a partial view of the spring retainer arm shown in FIG. 2 illustrating the swing arm stop bar.

DESCRIPTION OF THE PREFERRED EMBODIMENT

Figures 2, 6:
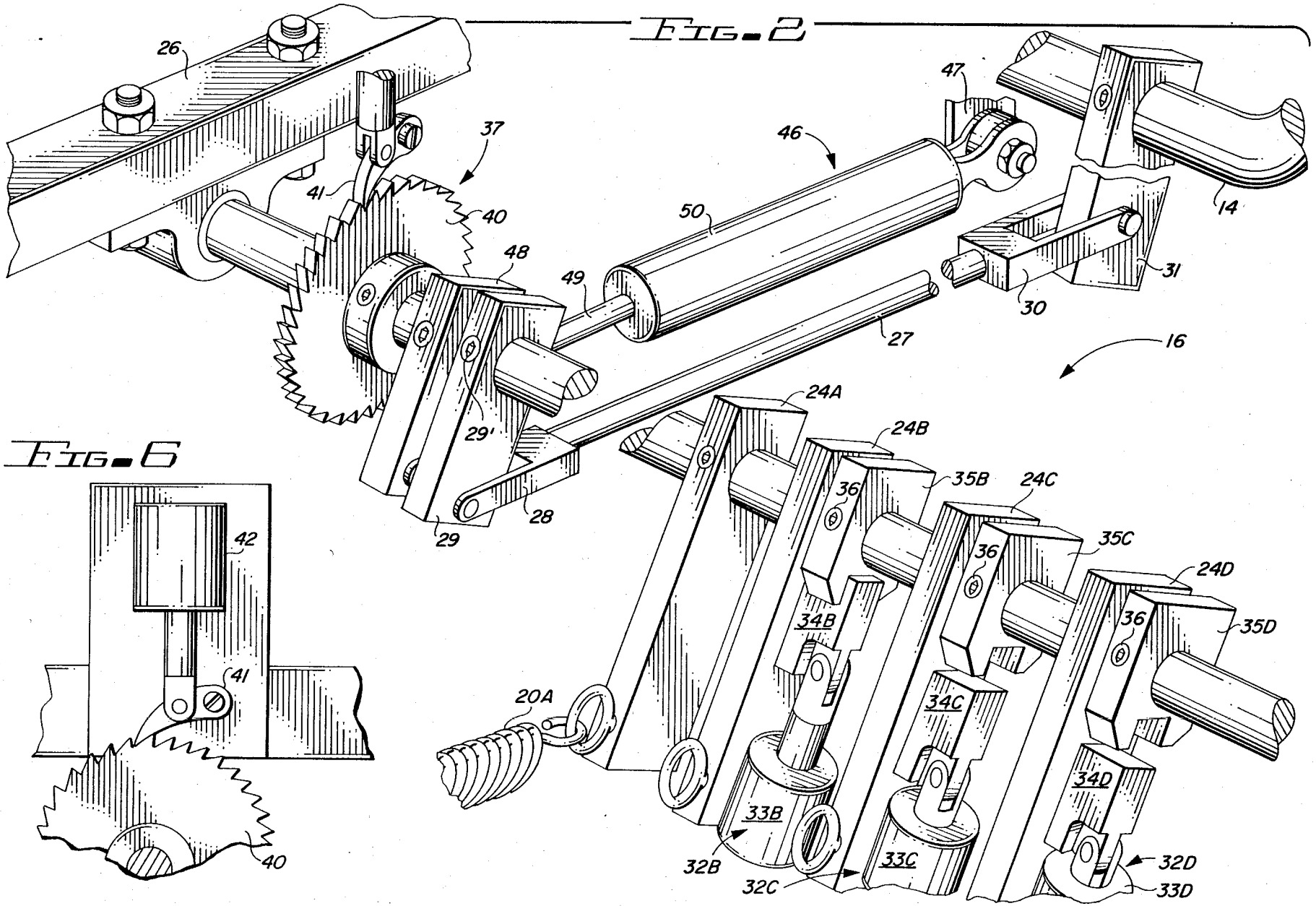
FIG. 2 is an enlarged partial perspective view of the pivoting arm structure and its connection to one or more of a number of coil spring solenoid operated resistance means.
FIG. 6 is an enlarged view of the ratchet lockout mechanism for the start and stop of a game as shown in FIG. 2.

Referring more particularly to the drawings by characters of reference, FIG. 1 discloses a mechanical arm wrestling device or apparatus 10 comprising a suitable support or table 11 having an upper top or horizontal supporting surface 12 for the contestant's elbow. Fixed to this surface is an elbow rest area or cup 13 in which the contestant places his or her elbow. A pivotally mounted lever or arm structure 14 is arranged to extend through a raised display panel 15 forming a part of the top surface of the table and is connected with a selectable coil spring solenoid controlled mechanism 16 shown in FIG. 2. The arm structure 14 is secured to the table of a suitable height depending on whether the contestant is standing or sitting adjacent the arm structure 14. An elbow pad or cup 13 is mounted on the support surface 12 adjacent the arm structure and a bumper block or pinning pad 17 is positioned on the table top for receiving the hand and arm when the attached spring is overcome. This pinning or depressible touch pad comprises an electrical switch 17A which is closed in response to depression of the touch pad to energize a light on signal 17B.

In a conventional arm-wrestling match, a score or winning condition is obtained when the contestant's forearm is extended generally parallel to the support surface 12 of the table and/or the wrist of one of a pair of contestants is in contact with the surface of the table. This position constitutes a win or score for the contestant, and such is the case with the disclosed device.

In accordance with the invention claimed, a plurality of springs 20A–20D are located within the confines of table 14 forming a part of the coil spring solenoid controlled mechanism 16 and are parallelly arranged with each other and with one end 21 thereof of each spring suitably attached and anchored to a common frame member 22 of table 14, as shown in FIG. 3. The other end 23 of each of springs 20A–20D are individually connected through mounting plates 24A–24D mounted on and extending outwardly of a rotatable drive shaft 25 which is journalled within and supported by a frame member 26 of table 11, a part of which is shown in FIG. 2.

This drive shaft 25 is rotated by a drive arm 27 which is pivotally connected at one end 28 to a mounting plate 29 fixedly attached to drive shaft 25 by a set screw 29', as shown in FIG. 2 and pivotally connected at its other end 30 through a mounting plate 31 to arm structure 14.

As shown in FIGS. 2 and 3, spring 20A is directly connected through plate 24A which is fixedly connected to shaft 25. Thus, arm structure 14 is at all times connected to spring 20A of the solenoid control mechanism 16.

Each of the other springs 20B, 20C and 20D are selectively connected to shaft 25 through their associated solenoid mechanism 32B, 32C and 32D. Each of these solenoid mechanisms comprise solenoid coils 33B–33D and associated armatures 34B–34D, which are mounted on their associated mounting plates 24B–24D.

It should be noted from FIG. 2 that plates 24B–24D are each pivotally mounted on drive shaft 25. Locking plates 35B–35D are adjacent each of the mounting plates 24B–24D and are each secured by a set screw 36 or the like to drive shaft 25, as shown.

Locking plates 35B–35D comprise U-shaped configurations with the ends of armatures 34B–34D of solenoid mechanisms 33B–33D, respectively, being selectively positionable between the legs of the respective U-shaped configurations for adding or removing the resistance of their respective springs 20B–20D to drive shaft 25.

When a particular solenoid coil, such as coil 33B is energized or deenergized depending on how the electrical system for the solenoid mechanism 16 is connected up, it will by movement of its armature add or remove the resistance of its associated spring to the total resistance applied to drive shaft 25 and particularly arm structure 14.

As shown in FIG. 2, coil 33B is energized and its associated armature 34B is actuated into interlocking arrangement with drive shaft 25 through its locking plate 35B. Solenoids 32C and 32D are shown in a deenergized condition and their associated mounting plates 24C and 24D and their solenoid coils 33C and 33D and armatures 34C and 34D mounted thereon are disconnected from drive shaft 25. Locking plates 35C and 35D fixedly attached to drive shaft 25 are not interlocked with the associated armature of these solenoids.

Thus, a means is provided for adding or removing spring resistance from the drive shaft 25.

As shown in FIGS. 2, 6 and 7, a lockout means such as a ratchet mechanism 37 may be employed for locking out and preventing the coil spring mechanism from operating when the starting switch is not energized either by moving switch 38 or dropping a given coin in a coin slot 39, shown in FIG. 1, to energize switch 38 in a well known manner.

The ratchet mechanism 37 comprises a ratchet gear 40 having an operating relationship therewith, in a well known manner, a ratchet pawl 41 which is biased into operation therewith by a spring mechanism (not shown). When the arm wrestling apparatus is properly energized by switch 38, a solenoid mechanism 42 operatively associated with the ratchet mechanism retrieves the pawl 41 to permit the drive shaft 25 to rotate under the influence of the arm structure 14.

In order to control the amount of movement of drive shaft 25, a stop 43 is provided on frame member 44 of table 11 which comprises a bolt and nut arrangement 45 which is adjustably positioned to limit and vary the movement of mounting plates 24B–24D. This stop may be in interference with only plate 24A as shown in FIG. 8 or in interference with any or all of the other mounting plates 24B–24D.

Thus, the rotation of drive shaft 25 under the influence of the contestant rotating arm structure 14 may be controlled and regulated.

In order to prevent the depressed arm structure 14 from flying back from its depressed condition by the contestant, a shock absorber 46 is pivotally mounted on a plate 47 secured to arm structure 14, as shown in FIG. 2, and extends therefrom in a parallel manner with drive arm 27 to a mounting plate 48 fixedly attached to drive shaft 25. Shock absorber 46 comprises the usual hydraulic or spring type shock absorber used on automobiles employing a plunger 49 which is driven into the housing 50 of the shock absorber when the contestant releases arm structure 14 after actuating it against selected biasing springs 20A–20D.

Figure 9:
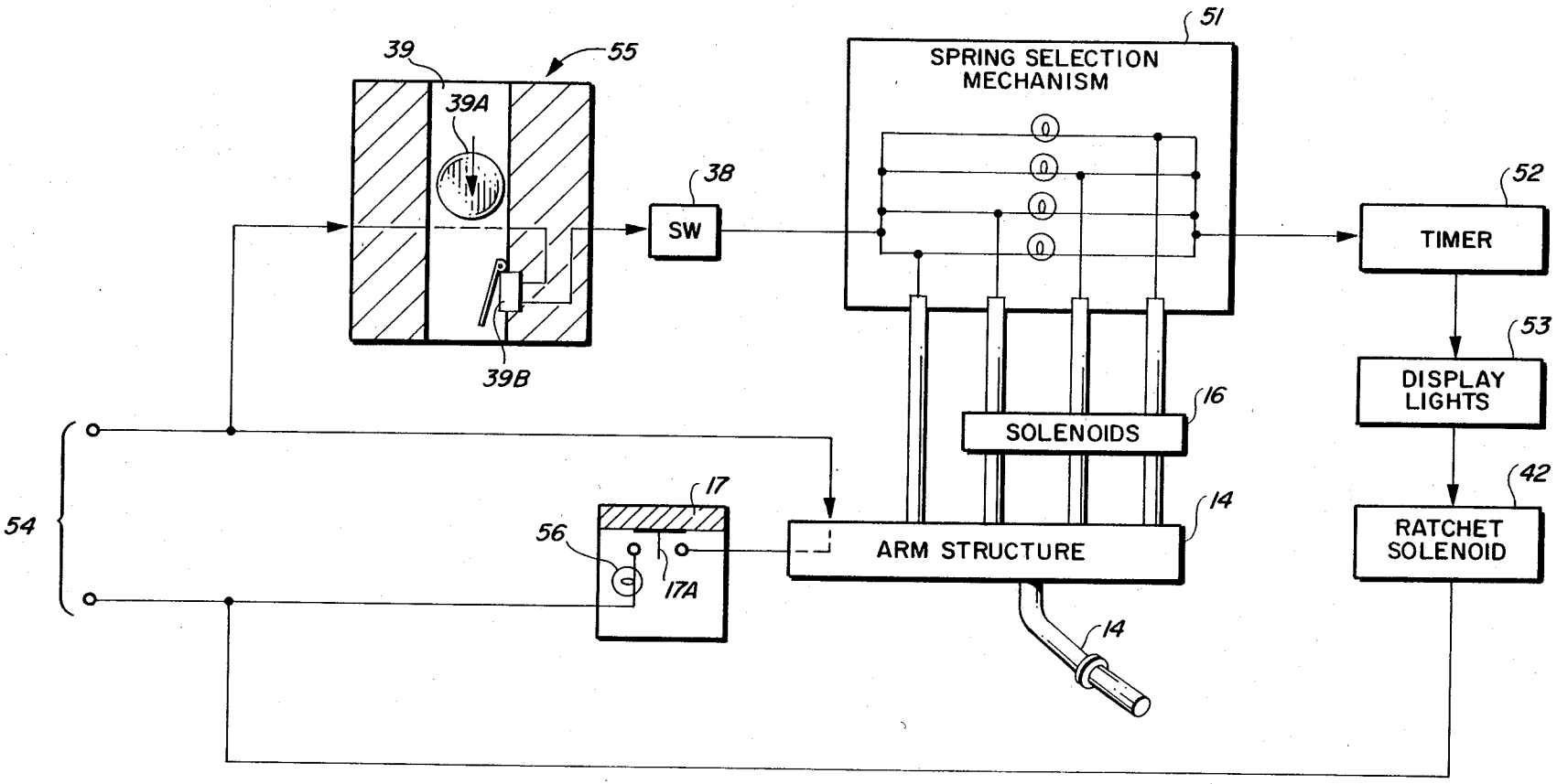
FIG. 9 illustrates a block diagram of a suitable electrical circuit for the apparatus disclosed.

FIG. 9 illustrates a simplified block diagram of a suitable electrical circuit for controlling signal lights, solenoids 16 and arm structure 14 and further discloses that a suitable spring selection mechanism 51 together with a timer 52 and win display light or lights 53 may be employed to complete the functioning of the disclosed arm wrestling apparatus.

A sequence of operation is as follows:

At the start of the game, contest or exercise the operator selects the spring resistance he desires through programming the spring selection mechanism 51 which merely energizes or not one or more of the solenoid coils 32B–32D. A predetermined coin is then inserted in coin slot 39 which completes an electric circuit from an electrical source 54 through an associated coin acceptance mechanism 55 (well known in the art) switch 38 which is actuated by the contestant, spring selection mechanism 51, timer 52, ratchet solenoid 42 and back to the source of electrical power 54.

At this point the contestant actuates arm structure 14 and if successful during a period of time selected by the timer 52 energizes the win light 55 and the game is completed.

If the contestant fails to overcome the selected springs in a given period of time, the timer 52 deenergizes the electrical circuit, thereby deenergizing the solenoid ratchet 42 and the movement of shaft 25 is stopped by ratchet pawl 41 engaging the teeth of ratchet wheel 40.

Although but one embodiment of the invention has been illustrated and described, it will be apparent to those skilled in the art that various changes and modifications may be made therein without departing from the spirit of the invention or from the scope of the appended claims.

What is claimed is:

1. An arm wrestling apparatus comprising:

a frame forming a table-like playing surface, moveable handle means located on said frame and positioned above said surface for grasping and moving by a user, a drive shaft journalled on said frame and connected to said handle means for rotation thereby, adjustable biasing means connectable to said drive shaft for urging pivotal movement of said handle means in one direction, said biasing means comprising a plurality of springs, some of which are selectively connectable to said drive shaft, and a solenoid means for selectively connecting said springs to said drive shaft associated with each of said springs stop means associated with said frame means adjacent said drive shaft for limiting the extent of rotative movement of said handle means, an elbow rest area positioned on said table-like playing surface and located below said handle means with the user putting his/her elbow in the elbow rest area and grasping said handle means when the apparatus is in use, said handle means being moveable from an upper position down to a lower position at a level comparable to and to the side of the elbow area, a depressable touch pad and a pad switch for scoring said touch pad linked to said pad switch operable in response to depression thereof, an electrical signal means actuably connected to said touch pad, a first circuit means for connecting said pad switch across a source of electrical power, lockout means releasably engaging said drive shaft to prevent use of said apparatus, solenoid means for controlling said lockout means to prevent unauthorized use of the apparatus, a timer for controlling the length of authorized use of the apparatus, means for selecting the springs to be connected to said drive shaft, a coin acceptor, and a second electrical circuit means for connecting in series across a source of electrical power said coin acceptor, the solenoids connected to the user selected springs, said timer and said solenoid means.

2. The arm wrestling apparatus set forth in claim 1 wherein:

said means for selecting the springs is mounted on said table-like playing surface.

3. The arm wrestling apparatus set forth in claim 1 in further combination with:

a switch mounted on said surface for actuating said second circuit means.

4. The arm wrestling apparatus set forth in claim 1 in further combination with:

a shock absorber mounted to extend between said frame and said drive shaft for controlling the rotation of said drive shaft in a second direction.

5. The arm wrestling apparatus set forth in claim 1 wherein:

said lockout means comprises a ratchet device.

6. The arm wrestling apparatus set forth in claim 1 wherein:

said solenoids are mounted on said drive shaft and when energized connect the associated springs to said drive shaft to bias its movement in said one direction.

7. The arm wrestling device set forth in claim 1 wherein:

said springs comprises coil springs.

* * * * *